US009191760B2

(12) United States Patent
Santek

(10) Patent No.: US 9,191,760 B2
(45) Date of Patent: Nov. 17, 2015

(54) OPTIMAL PRE-LOAD FOR FLOATING MASS TRANSDUCERS

(71) Applicant: Vibrant Med-El Hearing Technology GmbH, Innsbruck (AT)

(72) Inventor: Michael Santek, Innsbruck (AT)

(73) Assignee: Vibrant Med-El Hearing Technology GmbH, Innsbruck (AT)

( * ) Notice: Subject to any disclaimer, the term of this patent is extended or adjusted under 35 U.S.C. 154(b) by 227 days.

(21) Appl. No.: 13/925,959

(22) Filed: Jun. 25, 2013

(65) Prior Publication Data

US 2013/0345495 A1 Dec. 26, 2013

Related U.S. Application Data

(60) Provisional application No. 61/663,788, filed on Jun. 25, 2012.

(51) Int. Cl.
*H04R 25/00* (2006.01)

(52) U.S. Cl.
CPC ..... *H04R 25/606* (2013.01)

(58) Field of Classification Search
CPC ..... H04R 25/00; H04R 25/60; H04R 25/604; H04R 25/606; H04R 25/456; A61F 2/18; A61F 2002/183
USPC ..... 600/25
See application file for complete search history.

(56) References Cited

U.S. PATENT DOCUMENTS

| | | | | |
|---|---|---|---|---|
| 6,217,508 | B1 | 4/2001 | Ball et al. | |
| 6,398,717 | B1 | 6/2002 | Leysieffer et al. | |
| 7,273,447 | B2 | 9/2007 | Schneider et al. | |
| 7,628,812 | B2 | 12/2009 | aWengen et al. | |
| 2009/0131742 | A1 * | 5/2009 | Cho et al. | 600/25 |
| 2009/0259090 | A1 | 10/2009 | Parker | |
| 2011/0218386 | A1 | 9/2011 | Ball et al. | |

OTHER PUBLICATIONS

International Searching Authority, Authorized Officer Shane Thomas, International Search Report and Written Opinion—PCT/US13/47473, date of mailing Nov. 8, 2013, 22 pages.

* cited by examiner

*Primary Examiner* — Samuel Gilbert
(74) *Attorney, Agent, or Firm* — Sunstein Kann Murphy & Timbers LLP

(57) ABSTRACT

A middle ear implant arrangement is described which includes an implantable electromechanical transducer with an inner end and an outer end, for converting an input electrical stimulation signal into a corresponding output mechanical stimulation signal. A cochlear engagement member at the inner end of the transducer has a cochlear engagement surface for coupling the mechanical stimulation signal to an outer cochlear surface of a recipient patient. A transducer loading structure has: i. an inner end adapted to releasably engage the transducer, ii. an outer end elongated along a central end axis for engaging a fixed anatomical structure within the middle ear of the recipient patient, and iii. a center spring structure connecting the inner end and the outer end and adapted to expand along a central spring axis to develop a spring force between the fixed anatomical structure and the outer end of the transducer.

26 Claims, 7 Drawing Sheets

OPTIMAL PRE-LOAD FOR FLOATING MASS TRANSDUCERS

This application claims priority from U.S. Provisional Patent Application 61/663,788, filed Jun. 25, 2012, which is incorporated herein by reference.

TECHNICAL FIELD

The present invention relates to medical implants, and more specifically to a novel ossicular prosthesis arrangement.

BACKGROUND ART

A normal ear transmits sounds as shown in FIG. 1 through the outer ear 101 to the tympanic membrane (eardrum) 102, which moves the ossicles of the middle ear 103 (malleus, incus, and stapes) that vibrate the oval window and round window openings of the cochlea 104. The cochlea 104 is a long narrow duct wound spirally about its axis for approximately two and a half turns. It includes an upper channel known as the scala vestibuli and a lower channel known as the scala tympani, which are connected by the cochlear duct. The cochlea 104 forms an upright spiraling cone with a center called the modiolar where the spiral ganglion cells of the acoustic nerve 105 reside. In response to received sounds transmitted by the middle ear 103, the fluid-filled cochlea 104 functions as a transducer to generate electric pulses which are transmitted to the cochlear nerve 105, and ultimately to the brain.

Hearing is impaired when there are problems in the ability to transduce external sounds into meaningful action potentials along the neural substrate of the cochlea 104. To improve impaired hearing, auditory prostheses have been developed. For example, when the impairment is related to operation of the middle ear 103, a conventional hearing aid may be used to provide acoustic-mechanical stimulation to the auditory system in the form of amplified sound.

Middle ear implants also have been developed that employ electromagnetic transducers to mechanically stimulate the structures of the middle ear 103. A coil winding is held stationary by attachment to a non-vibrating structure within the middle ear 103 and a microphone signal current is delivered to the coil winding to generate an electromagnetic field. A magnet is attached to an ossicle within the middle ear 103 so that the magnetic field of the magnet interacts with the magnetic field of the coil. The magnet vibrates in response to the interaction of the magnetic fields, causing vibration of the bones of the middle ear 103. See U.S. Pat. No. 6,190,305, which is incorporated herein by reference.

Middle ear implants using electromagnetic transducers can present some problems. Many are installed using complex surgical procedures which present the usual risks associated with major surgery and which also require disarticulating (disconnecting) one or more of the bones of the middle ear 103. Disarticulation deprives the patient of any residual hearing he or she may have had prior to surgery, placing the patient in a worsened position if the implanted device is later found to be ineffective in improving the patient's hearing.

Novel surgical approaches try to deal with these issues by fixing an electromechanical transducer to the ossicle bones and placing an engagement member of the transducer against the oval or round window of the cochlear outer surface. The transducer is pressed toward the window membrane by filling fascia into the space between the transducer and a fixing anatomical structure. Fascia has the advantage of being biocompatible and having suitable damping properties to stabilize the fixing of the transducer and the engagement member to prevent their wandering out of place. But this approach very much depends on the exact execution of the filling of fascia and yields non-reproducible results. And either too much or too little exerted pressure on the membrane yields a distorted acoustic signal as perceived by the patient.

SUMMARY OF THE INVENTION

Embodiments of the present invention are directed to a middle ear implant arrangement responding to the above problems with the transducer loading structure from claim 1. Further advantageous embodiments of the present invention are in the dependent claims.

An implantable electromechanical transducer with an inner end and an outer end, converts an input electrical stimulation signal into a corresponding output mechanical stimulation signal. A cochlear engagement member at the inner end of the transducer has a cochlear engagement surface for coupling the mechanical stimulation signal to an outer cochlear surface of a recipient patient. A transducer loading structure has: i. an inner end adapted to releasably engage the transducer, ii. an outer end elongated along a central end axis for engaging a fixed anatomical structure within the middle ear of the recipient patient, and iii. a center spring structure connecting the inner end and the outer end and adapted to expand along a central spring axis to develop a spring force between the fixed anatomical structure and the outer end of the transducer.

More specifically, the center spring structure may include a first spring section toward the outer end of the transducer loading structure extending radially outward away from the central spring axis, and a second spring section toward the inner end of the transducer loading structure extending radially outward away from the central spring axis opposite to the first spring section. At least one of the spring sections may have a rectangular, hexagonal or elliptic cross-section. In addition or alternatively, the first spring section may have a larger cross-section and/or a larger spring-constant than the second spring section. At least one of the spring sections may include a relatively narrow sub-section. Some or all of the transducer loading structure may have chamfered edges.

The spring force may develop within a predetermined range when compressing the loading structure not more than a predetermined length along the end axis. The outer end of the engagement member may include a cone-shaped end, a spherical-shaped end, or a bolt-shaped end. The outer end of the engagement member may be adapted to releasably engage within an outer end sleeve. The transducer loading structure may be substantially flat. The transducer loading structure may be integrally formed, for example, of Nitinol.

DETAILED DESCRIPTION OF SPECIFIC EMBODIMENTS

Various embodiments of the present invention are directed to a middle ear implant arrangement based on a loading structure for a hearing implant transducer that is adapted to develop a spring force that presses one end of the electromechanical transducer to firmly engage it against an outer surface of the implant patient's cochlea.

Figure 1:
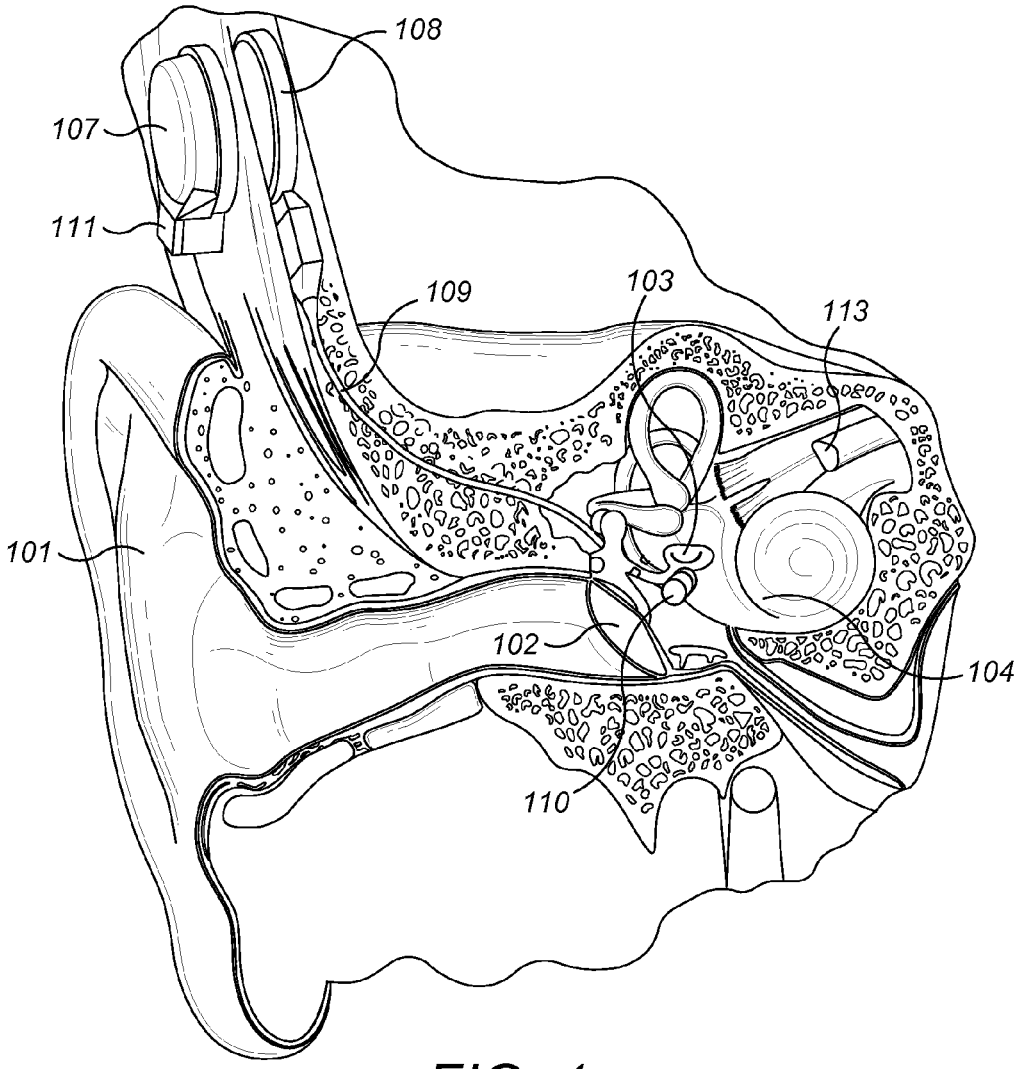
FIG. 1 shows various anatomical structures of a normal human ear.
Figure 2:
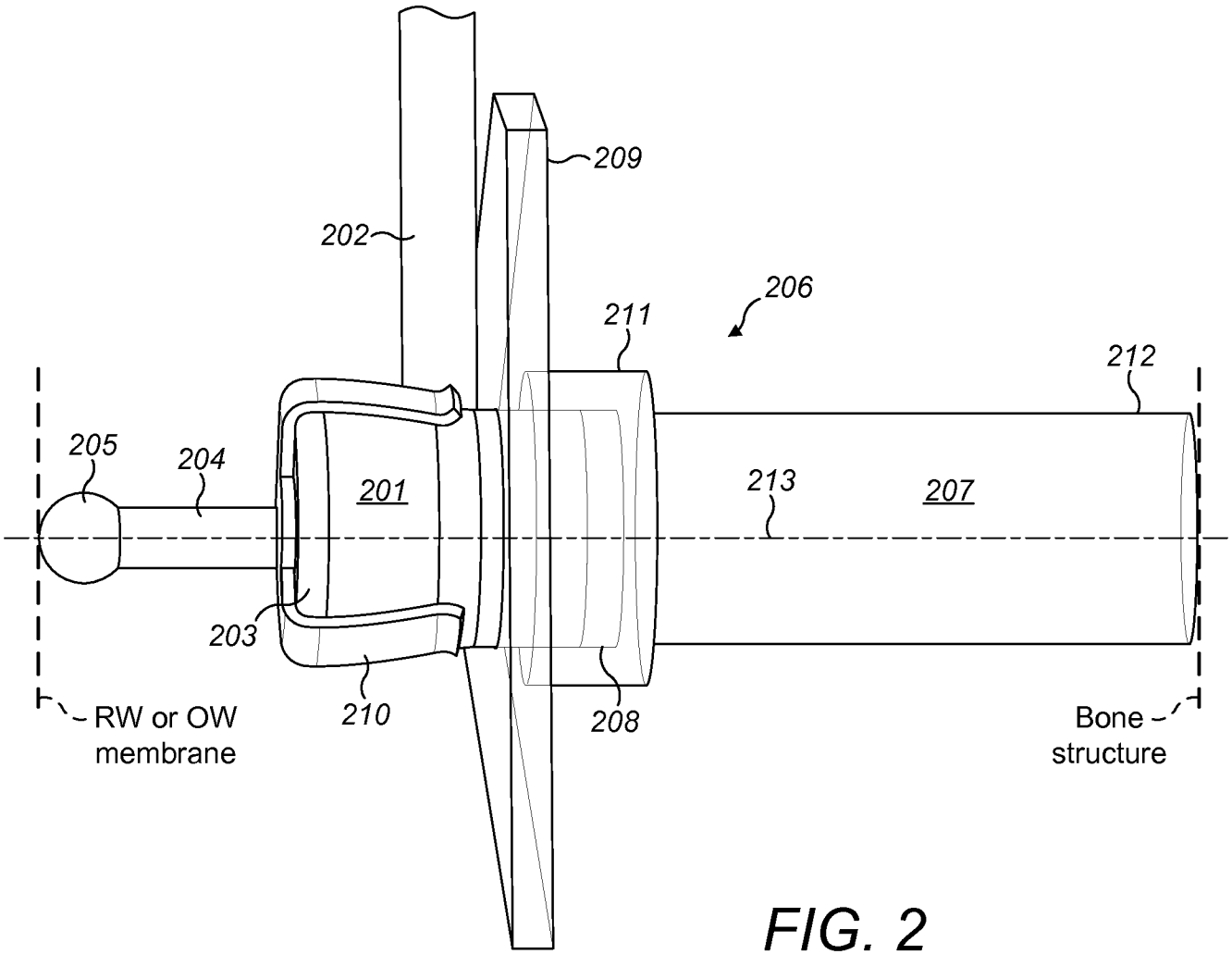
FIG. 2 shows an example of a middle ear implant arrangement according to an embodiment of the present invention.

FIG. 2 shows one specific embodiment where an implantable electromechanical transducer 201 such as a floating mass transducer converts an electrical stimulation signal input from FMT signal lead 202 into a corresponding mechanical stimulation signal output. The transducer 201 has a cylindrical shape with an inner end 203 and an outer end 208. A cochlea engagement member 204 at the inner end 203 of the electromechanical transducer 201 has an engagement surface 205 for coupling the mechanical stimulation signal to an outer cochlear surface of a recipient patient, for example, the round window or oval window membrane.

A transducer loading structure 206 has an inner end 211 that fits over and engages the outer end 208 of the electromechanical transducer 201, and a limiter flange 209 that engages snuggly against the FMT signal lead 202. The transducer loading structure 206 also has an outer end 212 that engages a fixed anatomical structure within the middle ear of the recipient patient, for example, bone mass within the middle ear of the recipient patient such as the temporal bone. The transducer loading structure 206 is adapted to expand along a central spring axis 207 to develop a spring force between the fixed anatomical structure and the outer end 208 of the electromechanical transducer 201 to firmly engage the engagement surface 205 against the outer cochlea surface.

For example, the transducer loading structure 206 may be formed of a compressible material such as implant grade silicone that may be compressed and shortened by surgical forceps during implantation surgery so that the inner end 211 of the loading structure 206 can be fit over the outer end 208 of the transducer 201 while rotating the outer end 212 of the loading structure 206 into position against the fixed bone mass. When the surgeon removes the forceps the loading structure expands along the center axis 213 of the transducer 201 to engage the engagement surface 205 against the cochlear membrane. The resulting firm engagement between the transducer 201 and the cochlea optimizes the coupling of the mechanical stimulation signal between the transducer 201 and the cochlea. It also secures the transducer 201 into a fixed position from which it does not drift over time, thereby maintaining that proper coupling over a prolonged lifetime of the device.

The outer end 212 of the loading structure 206 may be fixed in place against the bone mass by an end receiving recess in a fixed anchor plate of any biocompatible rigid material such as titanium. Such an end receiving recess may be based on a snap-in structure such as a spring flange that allows for rotational movement of the loading structure 206 while securing the outer end 212 in place up to some given tractive force that is sufficient for reliable fixation but small enough for easy surgical insertion and removal. Such recessed anchor plate provides reliable fixation to the bone mass with free rotational movement but avoids osseous-disintegration. The recess may be movable in at least one direction relative to the plate such that the outer end 212 of the loading structure 206 can be brought in place while the plate is e.g. fixed with screws to the anchoring bone mass and the force applied to the outer surface of the cochlea may therewith be adjusted. The movable recess may then be fixed to the plate.

Figure 3:
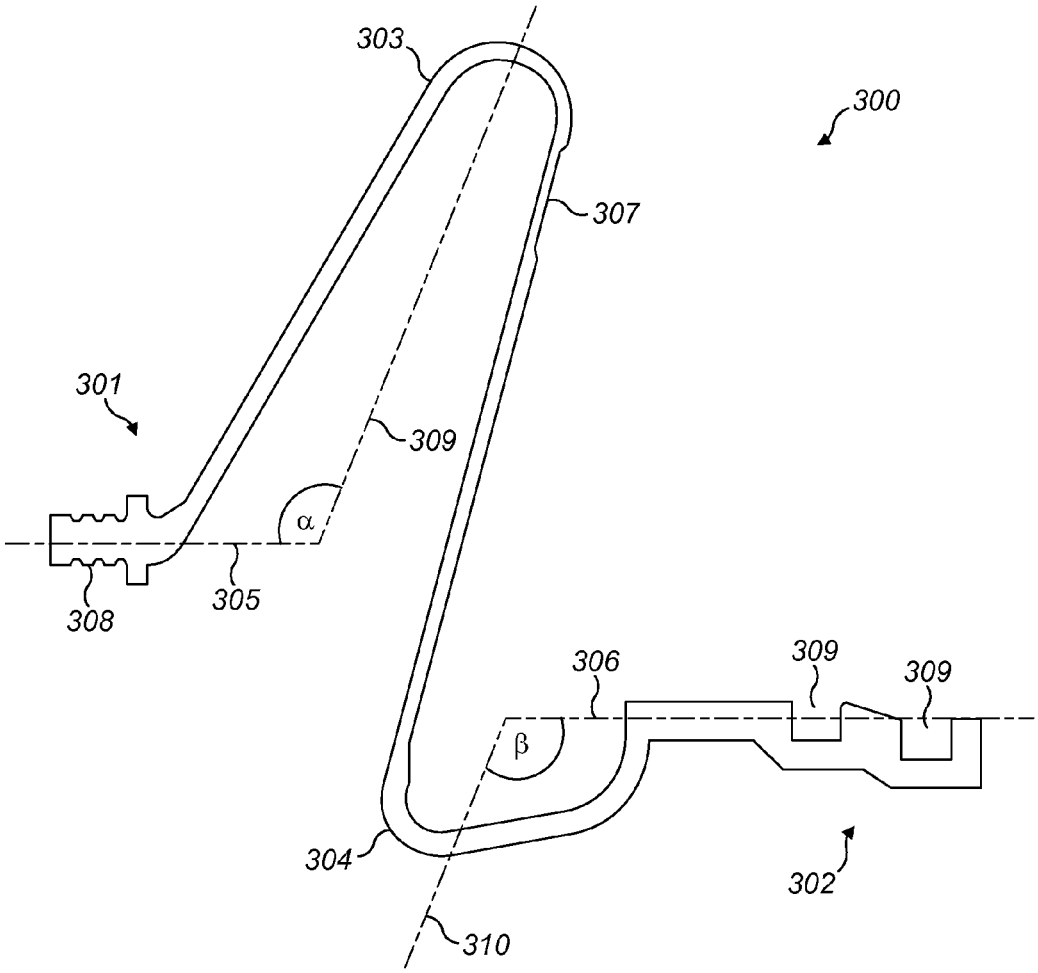
FIG. 3 shows an example of a middle ear transducer loading structure according to an embodiment of the present invention.

FIG. 3 shows an example of a spring-based transducer loading structure 300 according to an embodiment of the present invention, which has an inner end 302 adapted to engage the middle ear transducer and an outer end 301 adapted to fixedly anchor the loading structure 300 to a fixed bone mass within the middle ear such as the temporal bone. A first spring section 303 toward the outer end 301 of the transducer loading structure 300 extends radially outward away from a central spring axis 306. A second spring section 304 toward the inner end 302 of the transducer loading structure 300 extends radially outward away from the central spring axis 306 opposite to the first spring section 303.

Figure 4A:
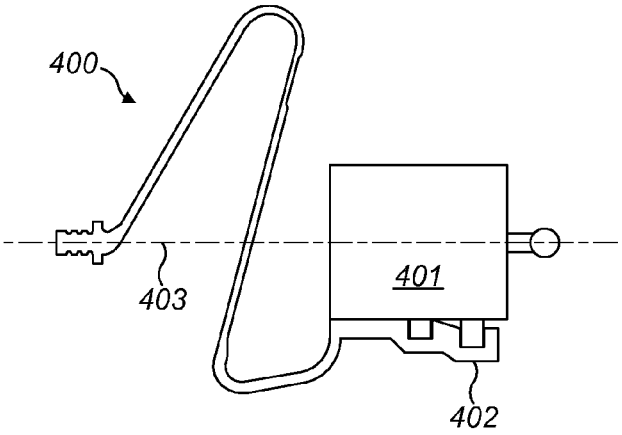
FIG. 4A-C shows various specific embodiments of a transducer loading structure that engage various sides of the transducer.
Figure 4B:
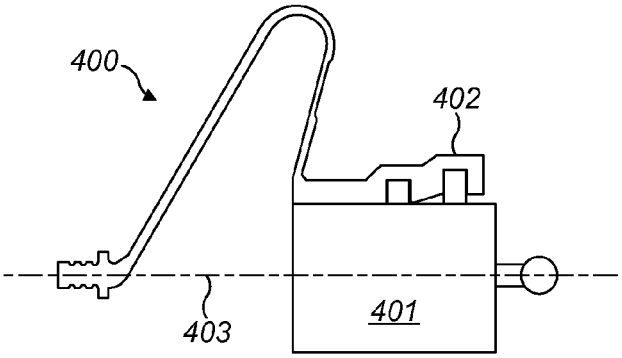
Figure 4C:
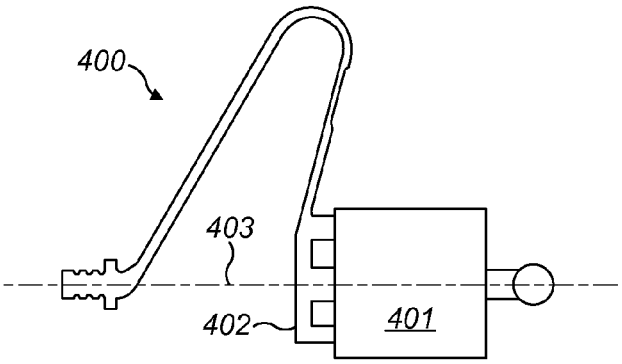

The inner end of the transducer loading structure may be adapted as shown in FIG. 4A-C to releasably engage various specific sides of the transducer. Specifically, FIG. 4A shows an embodiment of a transducer loading structure 400 where the inner end 402 is adapted to releasably engage to the transducer 401 on the lower side such that the axis of the cochlear engagement member and the transducer loading structure fall on the same line 403. A similar effect can be produced by adapting the inner end of the transducer loading structure 400 to releasably engage the upper side of the transducer 401 as shown in FIG. 4B. FIG. 4C shows an embodiment where the inner end of the transducer loading structure 400 is adapted to releasably engage the back side of the transducer 401 such that the axis of the cochlear engagement member and the transducer loading structure fall on the same line 403.

Figure 5A:
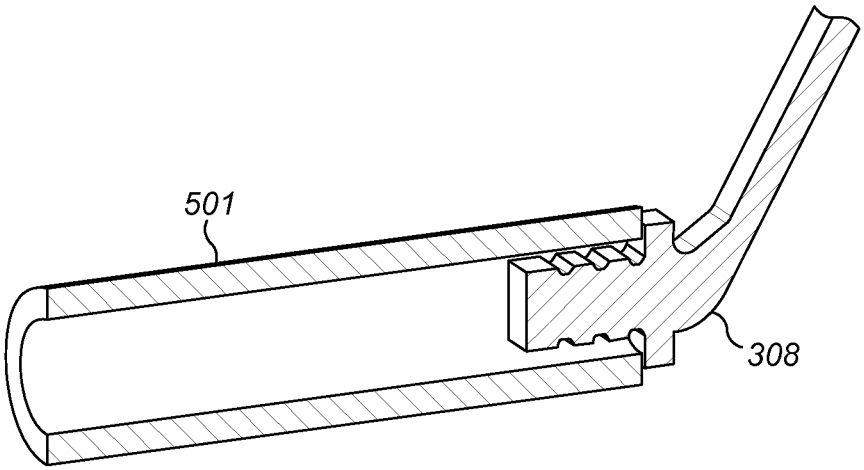
FIG. 5A-B shows the outer end of a transducer loading structure adapted to receive a fitting sleeve.
Figure 5B:
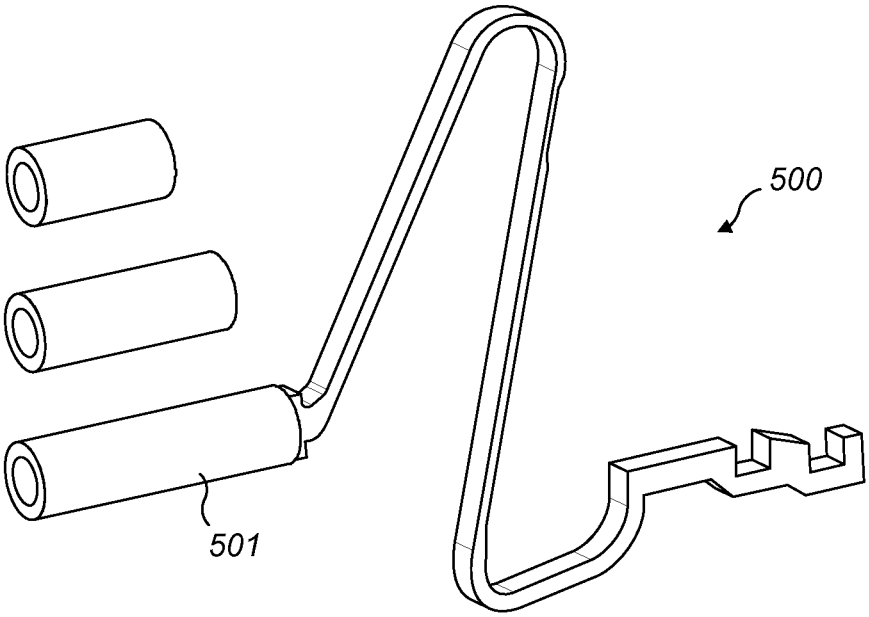

The outer end 301 of the transducer loading structure 300 may have a cone-shaped end, a spherical-shaped end, or a bolt-shaped end 308 which releasably engages within an outer end sleeve 501 as shown in FIG. 5A-B. The length of the outer end sleeve 501 may be selected to optimize the fit of the transducer loading structure 300 into position at a desired spring force. The outer end sleeve may be made of titanium that is crimped on the end 308 with pliers or tweezers.

In the embodiment shown in FIG. 3, the first spring section 303 is elongated along a first section axis 309 at a first section angle $\alpha$ to an end axis 305 that is parallel to the spring axis 306. Similarly, the second spring section 304 is elongated along a second section axis 310 at a second section angle $\beta$ to the spring axis 306. It is advantageous for first section angle $\alpha$ and/or the second section angle $\beta$ to be more than 90 degrees—e.g., 135 degrees as shown in FIG. 3—in order to accommodate the fit of the transducer loading structure 300 into the narrow confines of the middle ear cavity between the cochlear out surface engaged by the transducer and the fixed bone mass anchoring the transducer loading structure 300.

At least one of the spring sections 303 and/or 304 may have a rectangular, hexagonal or elliptic cross-section, which may vary in size and shape over distance. And some or all of the transducer loading structure 300 may have chamfered edges, which may help minimize trauma to nearby tissue when inserting the arrangement into position in the middle ear. In some embodiments, the cross-section and/or the spring-constant of the first spring section 303 may be larger than that of the second spring section 304. This may help control or absorb vibrations and/or be helpful to avoid contacting bone mass. FIG. 3 also shows the first spring section 303 having a relatively narrow sub-section 307 to help reduce the spring constant of the first spring section 303. Locating the narrow sub-section 307 in a straight portion of the first spring section 303 may be preferable over in part of the bending arc at the radial end of the first spring section 303 to avoid undesirable vibration and to provide for stable fixation of the arrangement over a long period of time after implantation surgery.

The transducer loading structure 300 may be integrally formed which may allow for easy manufacturing such as preferably by a chemical etching process. The transducer loading structure 300 should be made of a material that is biocompatible and sufficiently elastic to exert the desired spring force, for example, Nitinol that is 55.9% nickel and 44.09% titanium by weight.

The transducer loading structure 300 shown in FIG. 3 is substantially flat to promote easy surgical insertion that allows the surgeon a free view to the oval or round window. During surgical implantation, the surgeon compresses the transducer loading structure 300 with forceps to fit the arrangement into proper position in the middle ear between the cochlear outer surface and the fixed bone mass. The spring force may develop within a predetermined range when compressing the transducer loading structure 300. But having a range of exerted spring force that is too low and/or too high may distort the perceived sound signal. Tests on cadaver heads have shown that a preferred range of spring force to achieve optimal coupling may be more than 0.01 N and less than 0.03 N. This range is well-suited to achieve the best fit and coupling and long-term stable fixation. In other embodiments, the predetermined range of spring force may be between 0.005 N and 0.04 N, preferably between 0.01 N and 0.03 N. Similarly, the surgical compression of the transducer loading structure 300 may be limited to a predetermined length, for example, more than 2 mm and less than 5 mm.

Figure 6:
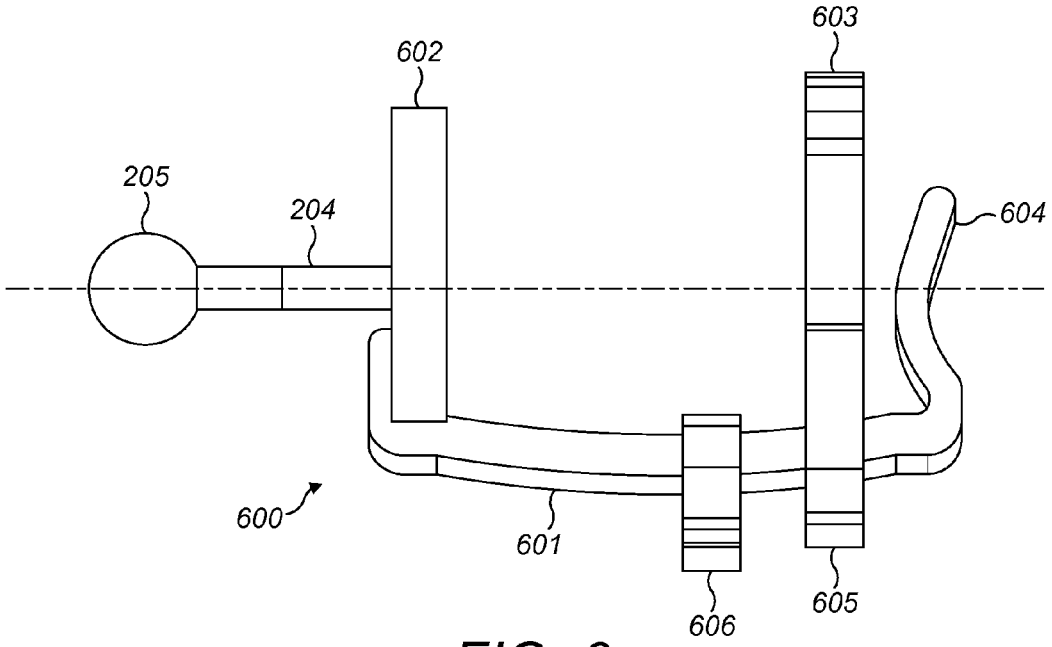
FIG. 6 shows a side view of a transducer holding structure adapted to couple to a transducer holding member.

In some systems, the transducer may be held securely within a transducer holding structure 600 as shown in FIG. 6 that fits around the transducer. The inner end of the transducer holding structure 600 incorporates the cochlea engagement member 204 and the engagement surface 205 that couples vibrations from the enclosed transducer via a coupling flange 602 to the outer cochlear surface. The transducer holding structure shown in FIG. 6 also has one or more longitudinal support members 601 that support the enclosed transducer from below. An inner rib 606 provides stiffening for the longitudinal support member 601 and provides a coupling surface for the transducer loading structure to engage, as does outer rib 605. One or both of the ribs 605 and/or 606 may extend up and around to form an enclosing rib 603 that helps secure the transducer within the transducer holding structure 600. And the outer end 604 of the transducer holding structure 600 may be bent into a spring shape that also helps securely hold the enclosed transducer. Any of the specific embodiments of transducer loading structure 400 shown in FIG. 4A-C may be adapted to engage such a transducer holding structure 600 rather than the transducer 401 proper.

Figure 7A:
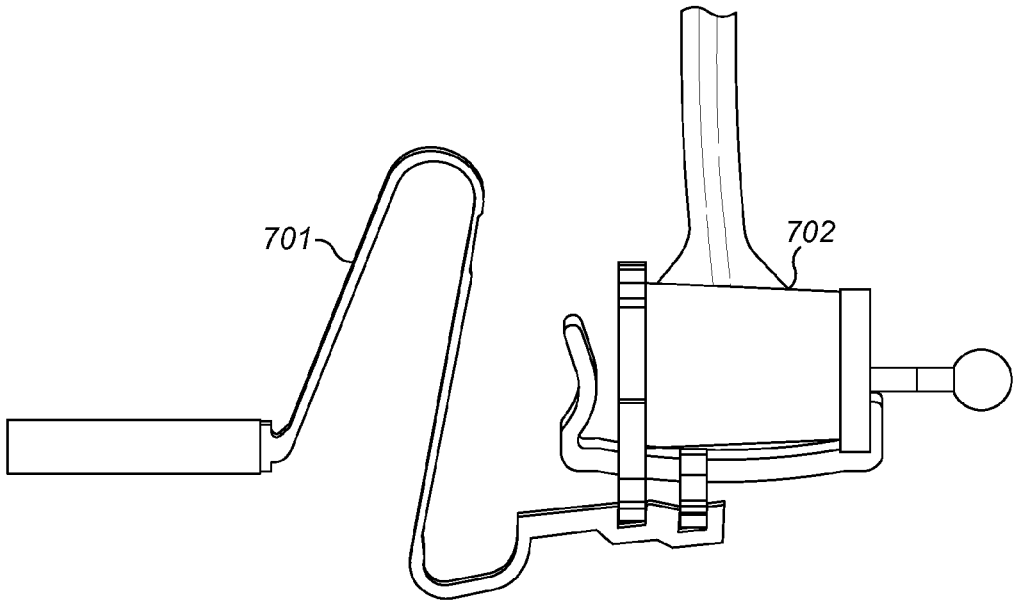
FIG. 7A-B show photographs of a middle ear implant arrangement having a transducer loading structure.
Figure 7B:
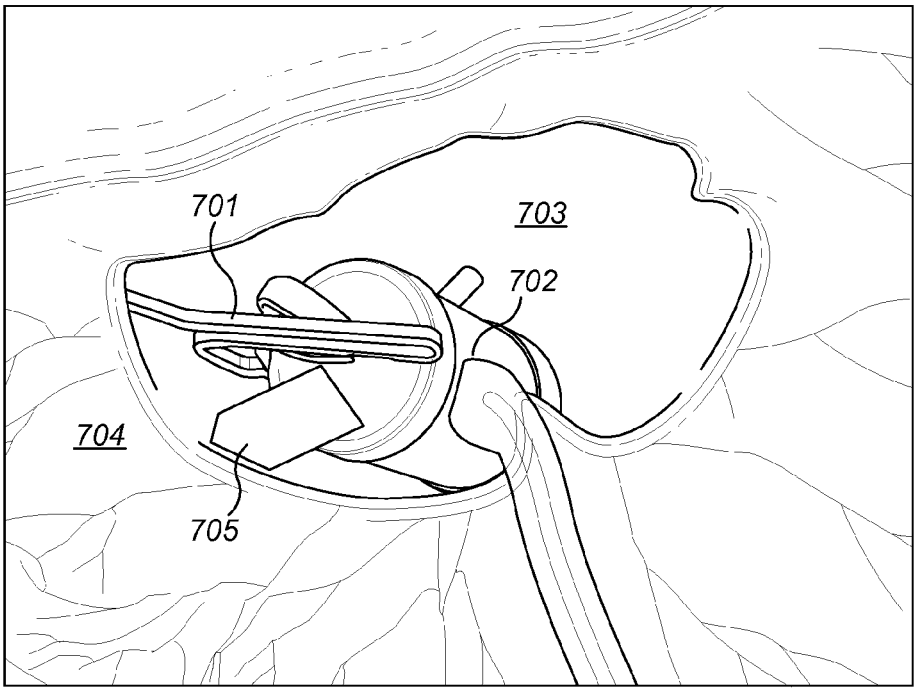

FIG. 7A-B show photographs of a middle ear implant arrangement having a transducer loading structure 701 that develops a spring force against fixed bone mas 704 in the middle ear to hold transducer 702 into position with the desired pressure against the round window membrane of the cochlear outer surface 703. Filling fascia 705 may further help stabilize the arrangement.

Although various exemplary embodiments of the invention have been disclosed, it should be apparent to those skilled in the art that various changes and modifications can be made which will achieve some of the advantages of the invention without departing from the true scope of the invention.

What is claimed is:

1. A middle ear implant arrangement comprising:
- an implantable electromechanical transducer having an inner end and an outer end, for converting an input electrical stimulation signal into a corresponding output mechanical stimulation signal;
- a cochlear engagement member at the inner end of the transducer having a cochlear engagement surface for coupling the mechanical stimulation signal to an outer cochlear surface of a recipient patient; and
- a transducer loading structure having:
  - i. an inner end adapted to releasably engage the transducer, and
  - ii. an outer end elongated along a central end axis configured for engaging a fixed anatomical structure within the middle ear of the recipient patient;
  - wherein the transducer loading structure forms a center spring structure between the inner end and the outer end and adapted to expand along a central spring axis to develop a spring force between the fixed anatomical structure and the outer end of the transducer.

2. An implant arrangement according to claim 1, wherein the center spring structure includes:
- a first spring section toward the outer end of the transducer loading structure extending radially outward away from the central spring axis; and
- a second spring section toward the inner end of the transducer loading structure extending radially outward away from the central spring axis opposite to the first spring section.

3. An implant arrangement according to claim 2, wherein at least one of the spring sections has a rectangular, hexagonal or elliptic cross-section.

4. An implant arrangement according to claim 2, wherein the first spring section has a larger cross-section than the second spring section.

5. An implant arrangement according to claim 2, wherein the first spring section has a larger spring-constant than the second spring section.

6. An implant arrangement according to claim 2, wherein at least one of the spring sections includes a relatively narrow sub-section.

7. An implant arrangement according to claim 2, wherein the transducer loading structure has chamfered edges.

8. An implant arrangement according to claim 1, wherein the spring force develops within a predetermined range when compressing the loading structure not more than a predetermined length along the end axis.

9. An implant arrangement according to claim 1, wherein the outer end of the transducer loading structure includes a cone-shaped end, a spherical-shaped end, or a bolt-shaped end.

10. An implant arrangement according to claim 1, wherein the outer end of the transducer loading structure is adapted to releasably engage within an outer end sleeve.

11. An implant arrangement according to claim 1, wherein the transducer loading structure is substantially flat.

12. An implant arrangement according to claim 1, wherein the transducer loading structure is integrally formed.

13. An implant arrangement according to claim 12, wherein the transducer loading structure is made of Nitinol.

14. A transducer loading structure for a middle ear implant comprising:
- an inner end adapted to releasably engage an end of an implanted electromagnetic transducer, and an outer end elongated along a central end axis configured for engaging a fixed anatomical structure within the middle ear of the recipient patient;

wherein the transducer loading structure forms a center spring structure between the inner end and the outer end adapted to expand along a central spring axis to develop a spring force between the fixed anatomical structure and the outer end of the transducer.

15. A transducer loading structure according to claim 14, wherein the center spring structure includes:

a first spring section toward the outer end extending radially outward away from the central spring axis; and a second spring section toward the inner end extending radially outward away from the central spring axis opposite to the first spring section.

16. A transducer loading structure according to claim 15, wherein at least one of the spring sections has a rectangular, hexagonal or elliptic cross-section.

17. A transducer loading structure according to claim 15, wherein the first spring section has a larger cross-section than the second spring section.

18. A transducer loading structure according to claim 15, wherein the first spring section has a larger spring-constant than the second spring section.

19. A transducer loading structure according to claim 15, wherein at least one of the spring sections includes a relatively narrow sub-section.

20. A transducer loading structure according to claim 15, wherein the loading structure has chamfered edges.

21. A transducer loading structure according to claim 14, wherein the spring force develops within a predetermined range when compressing the loading structure not more than a predetermined length along the end axis.

22. A transducer loading structure according to claim 14, wherein the outer end includes a cone-shaped end, a spherical-shaped end, or a bolt-shaped end.

23. A transducer loading structure according to claim 14, wherein the outer end is adapted to releasably engage within an outer end sleeve.

24. A transducer loading structure according to claim 14, wherein the transducer loading structure is substantially flat.

25. A transducer loading structure according to claim 14, wherein the transducer loading structure is integrally formed.

26. A transducer loading structure according to claim 25, wherein the transducer loading structure is made of Nitinol.

* * * * *

UNITED STATES PATENT AND TRADEMARK OFFICE

CERTIFICATE OF CORRECTION

PATENT NO. : 9,191,760 B2
APPLICATION NO. : 13/925959
DATED : November 17, 2015
INVENTOR(S) : Michael Santek It is certified that error appears in the above-identified patent and that said Letters Patent is hereby corrected as shown below:

IN THE CLAIMS

In Col. 6, line 20
delete "and"

Signed and Sealed this
Fifth Day of April, 2016

Michelle K. Lee

Michelle K. Lee
*Director of the United States Patent and Trademark Office*